United States Patent [19]

Seki et al.

[11] Patent Number: 4,565,162

[45] Date of Patent: Jan. 21, 1986

[54] COOLING SYSTEM OF AN INTERNAL COMBUSTION ENGINE

[75] Inventors: Nakanobu Seki, Yokohama; Yoshimasa Hayashi, Kamakura; Masakazu Uemura, Yokohama, all of Japan

[73] Assignee: Nissan Motor Co., Ltd., Yokohama, Japan

[21] Appl. No.: 351,748

[22] Filed: Feb. 24, 1982

[30] Foreign Application Priority Data

Feb. 27, 1981 [JP] Japan ..... 56-28849

[51] Int. Cl.[4] ..... F01P 3/22

[52] U.S. Cl. ..... 123/41.08; 123/41.21; 123/41.44

[58] Field of Search ..... 123/41.2, 41.21, 41.26, 123/41.08, 41.22, 41.23, 41.24, 41.25, 41.27, 41.19; 165/104.27, 104.32

[56] References Cited

U.S. PATENT DOCUMENTS

| | | | |
|---|---|---|---|
| 1,226,180 | 5/1917 | Bouton, Jr. | 123/41.26 |
| 2,403,218 | 7/1946 | Hanners | 123/41.26 |
| 3,181,308 | 5/1965 | Van Der Hagen | 123/41.19 |
| 3,256,868 | 6/1966 | Gratzmuller | 123/41.44 |
| 3,384,304 | 5/1968 | Barlow | 237/8 |
| 3,524,499 | 8/1970 | Senf | 165/110 |

FOREIGN PATENT DOCUMENTS

| | | | |
|---|---|---|---|
| 1155635 | 10/1963 | Fed. Rep. of Germany . | |
| 56-32029 | 1/1981 | Japan | 123/41.21 |
| 428261 | 4/1935 | United Kingdom . | |
| 693873 | 7/1953 | United Kingdom . | |
| 665112 | 5/1979 | U.S.S.R. | 123/41.21 |

*Primary Examiner*—William A. Cuchlinski, Jr.
*Attorney, Agent, or Firm*—Schwartz, Jeffery, Schwaab, Mack, Blumenthal & Evans

[57] ABSTRACT

A steam from a water jacket of the engine is pressurized to form a pressurized steam. The steam thus pressurized is then cooled and condensed by air-cooled condenser to form a pressurized water. The pressurized water is then decompressed to have a normal pressure and then introduced into the water jacket for recirculation.

15 Claims, 5 Drawing Figures

FIG.3
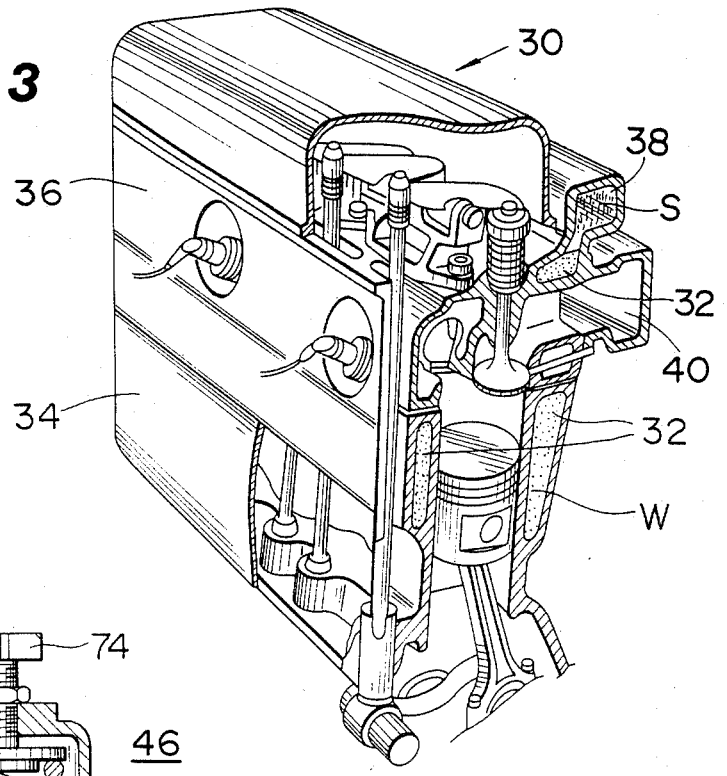
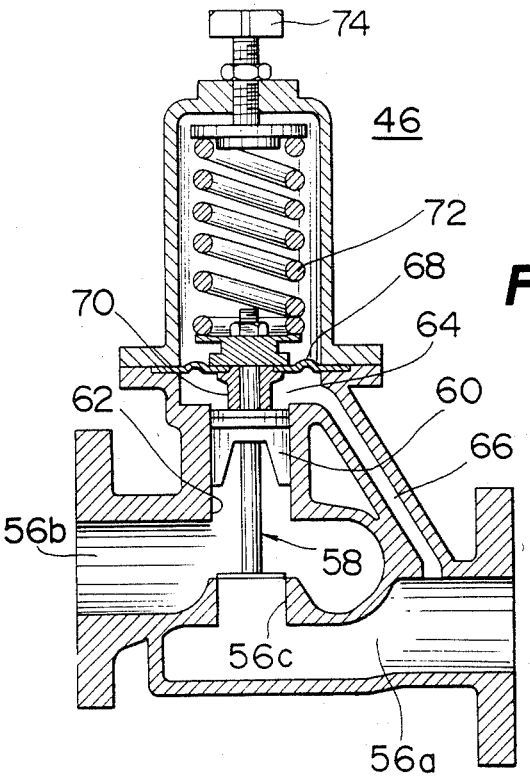
FIG.4

COOLING SYSTEM OF AN INTERNAL COMBUSTION ENGINE

BACKGROUND OF THE INVENTION

The present invention relates in general to a cooling system of an internal combustion engine, and more particularly to a cooling system of a water-cooled automotive internal combustion engine.

SUMMARY OF THE INVENTION

It is an object of the present invention to provide an improved cooling system of a water-cooled internal combustion engine, which system exhibits excellent cooling effect to the engine and is compact in size.

According to the present invention, there is provided a cooling system of an internal combustion engine which has a water jacket formed therein, the cooling system comprising first means defining a steam chamber in the engine, the steam chamber being merged with the water jacket and being filled with steam when the engine is under operation; second means for pressuring the steam issued from the first means to provide a pressurized steam; third means for cooling and condensing the pressurized steam to provide a pressurized water; fourth means for reducing the pressure of the pressurized water to provide water having a normal pressure; and fifth means for feeding the normally pressurized water into the water jacket of the engine.

BRIEF DESCRIPTION OF THE DRAWINGS

FIG. 3 is a partially cutaway perspective view of an internal combustion engine to which the cooling system of the present invention is applied;

FIG. 4 is a sectional view of a regulator valve which is employed in the cooling system of the invention.

BRIEF DESCRIPTION OF THE PRIOR ART

Figure 1:
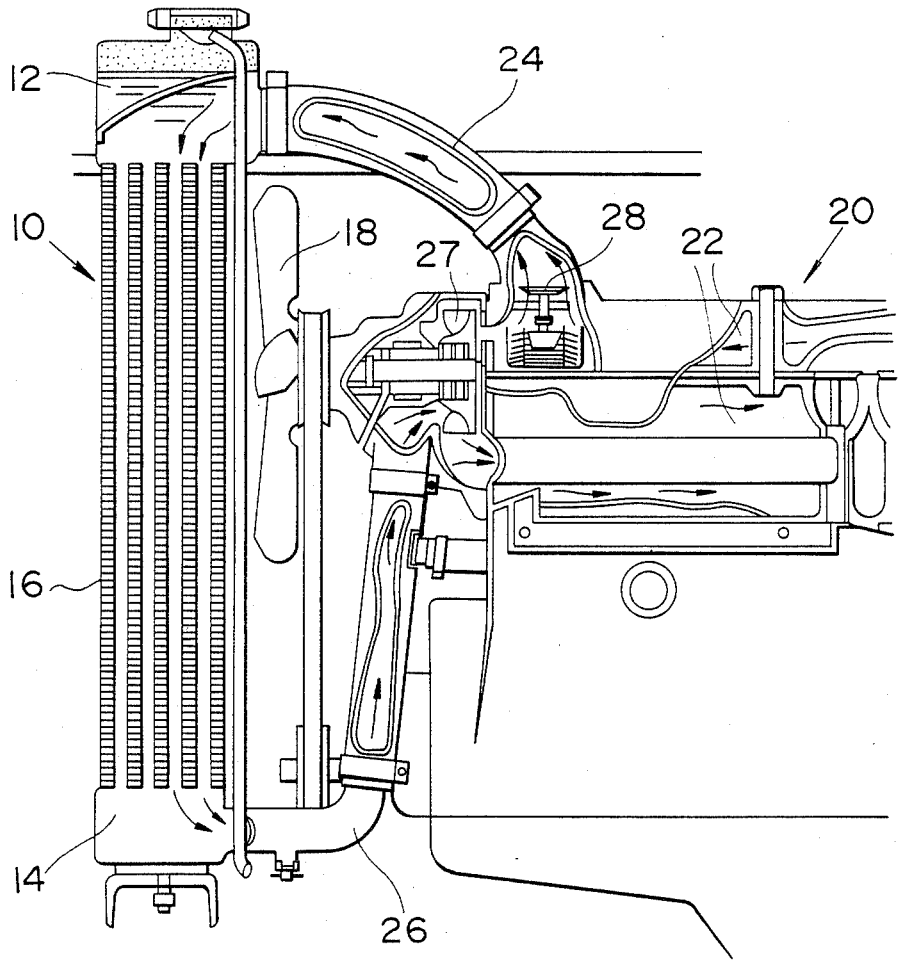
FIG. 1 PRIOR ART
FIG. 1 is a sectional view of a conventional cooling system of a water-cooled internal combustion engine.

Prior to describing the invention, a conventional cooling system of a water-cooled internal combustion engine will be outlined with reference to FIG. 1 in order to clarify the invention.

In FIG. 1, a typical cooling system of a water-cooled internal combustion engine is shown, which has a radiator 10 including a top tank 12, bottom tank 14 and a radiator core 16. A cooling fan 18 driven by the engine 20 is positioned between the radiator 10 and the engine 20 in order to draw cooling air through the radiator core 16. The engine 20 has a water jacket 22 formed therein, from which heated cooling water flows to the top tank 12 of the radiator 10 through an outlet hose 24. An inlet hose 26 connects the bottom tank 14 to a water pump 27 for transmitting cooled cooling water from the bottom tank 14 to an inlet of the water jacket 22. A thermostat 28 is disposed in the water jacket 22 to close off the water flow from the water jacket 22 to the radiator 10 until the engine has reached the desired operating temperature. In fact, at low temperature, the passage of the outlet hose 24 is closed and the water at the outlet of the water jacket 22 is directly drawn to the water pump 27.

However, the conventional cooling system of the above-mentioned type has a weak point from the point of view of compactness of the system. Because the temperature difference between the cooling water to be treated by the radiator 10 and the surrounding air is not enough for achieving effective heat exchanging therebetween, it sometimes becomes necessary to use a large-sized radiator or a large-sized cooling fan for satisfying the desired cooling of the engine. Employment of such large-sized parts or devices induces not only bulky construction of the cooling system but also increase of noise at the radiator and the fan.

DESCRIPTION OF THE INVENTION

It is therefore an essential object of the present invention to provide an improved cooling system of a water-cooled internal combustion engine which is free of the above-mentioned defects.

Figure 2:
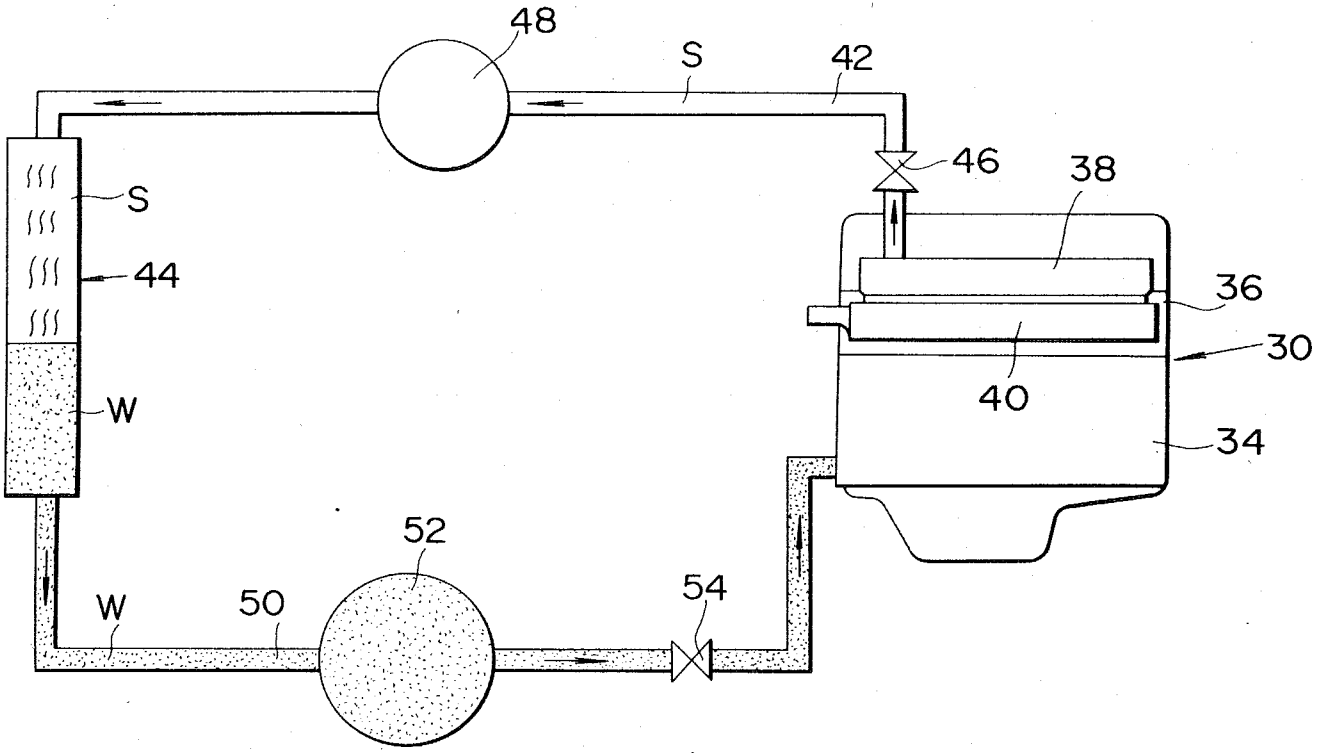
FIG. 2 is a schematic illustration of a cooling system of a first embodiment of the present invention.

Referring to FIG. 2, there is shown a cooling system of a first embodiment of the present invention. In this drawing, an internal combustion engine is designated by numeral 30. As is clearly shown by FIG. 3, the engine 30 has a water jacket 32 formed within the cylinder block 34 and within the cylinder head 36. A steam chamber 38 merged with the water jacket 32 is positioned above the intake manifold 40. A suitable amount of cooling water W is contained in the water jacket 32. Thus, under operation of the engine, the steam chamber 38 is filled with steam.

Referring again to FIG. 2, a conduit 42 extends from the steam chamber 38 to a condenser 44 through a regulator valve 46 and a compressor 48. Like the arrangement of the conventional radiator, the condenser 44 is mounted at a front portion of the vehicle in order to effectively use cooling air flow created at the vehicle cruising. Another conduit 50 extends from the condenser 44 to an inlet of the water jacket of the engine 30 through a reserve tank 52 and a pressure reducing valve 54.

In FIG. 4, the regulator valve 46 is shown in detail. The valve 46 is designed to open the passage of the conduit 42 only when the pressure in the steam chamber 38 exceeds a predetermined value. With its inherent construction, the open and close operation of the valve 46 is not affected by a pressure variation caused by the compressor 48. The regulator valve 46 comprises first and second bores **54*a* and 54*b* which are respectively communicated with the steam chamber 38 and the compressor 48. A valve body 58 having at its one end a piston 60 is axially movably arranged in the valve housing to selectively open and close an opening 56*c* which connects the first and second bores 56*a* and 56*b*. The piston 60 is sealingly and slidably received in a cylindrical bore 62 which is merged with the second bore 56*b*. A chamber 64 is defined above the piston 60, which is connected to the first bore 56*a* through a passage 66. The chamber 64 is bounded by a diaphragm 68. A strut 70 is disposed between the piston 60 and the diaphragm 68 in a manner to be movable therewith. The diaphragm 68 and thus the valve body 58 are biased downwardly in FIG. 4, that is in a direction to close the opening 50*c*, by a predetermined force created by a spring 72. The biasing force of the spring 72 is adjustable to a desired value by an adjusting screw 74. The pressure receiving area of the upper side of the valve proper and that of the lower side of the piston 60 are equal to each other, so that pressure in the second bore 50***b* does not cause movement of the valve body 58. However, the pressure receiving area of the lower side of the valve proper is greater than that of the upper side of the piston 60, so that when a force applied to the valve body 58 exceeds the predetermined biasing force of the spring 72, the valve body 58 is lifted to open the opening 56*c*. This lifting force is supplied by pressure in the first bore 56*a* because of the difference of the pressure receiving areas between the lower side of the valve proper and the upper side of the piston 60. Thus, the pressure in the first bore 56*a*, that is the pressure in the steam chamber 38 of the engine 30, is maintained constant without being influenced by pressure variation created by the compressor 48.

At the compressor 48, the steam S issued from the regulator valve 46 is subjected to an adiabatic compression, so that the steam S has a higher temperature and higher pressure than at the time when it is just discharged from the steam chamber 38. The steam S thus treated is then applied to the condenser 44. Although not shown in the drawing, a cooling fan may be arranged at the rear portion of the condenser 44 in order to forceably create an air flow which cools the condenser 44.

The steam S introduced into the condenser 44 is cooled and condensed to a liquid, that is pressurized water, and then the water is collected in the reserve tank 52. The water is then introduced into the pressure reducing valve 54 to have a normal pressure, and then introduced into the water jacket of the engine 30.

Thus, in the cooling system as described above, the heat conveying medium, that is steam S, which is to be cooled by the condenser 44 can possess a considerably high temperature thereby causing a considerable temperature difference between the cooling medium and the surrounding air. This induces effective heat exchanging between the heat conveying medium and the surrounding air as compared with the conventional cooling system described above, so that the condenser in the invention can have a smaller construction than is conventional. Experiment has revealed that the cooling fan for the condenser is almost unnecessary in the invention. Furthermore, since steam S is used as a substantial heat conveying medium, the amount of cooling water which circulates through the cooling system can be reduced in comparison with the conventional cooling system. Thus, the reserve tank 52 and its associated parts can be constructed smaller in size. Furthermore, with the usage of the regulator valve 46 and the pressure reducing valve 54, the interior of the water jacket of the engine 30 is not influenced by the pressure variation created by the compressor 48, so that not only the boiling point of the cooling water W in the engine water jacket is maintained constant, but also the compression efficiency of the compressor 48 is improved.

Figure 5:
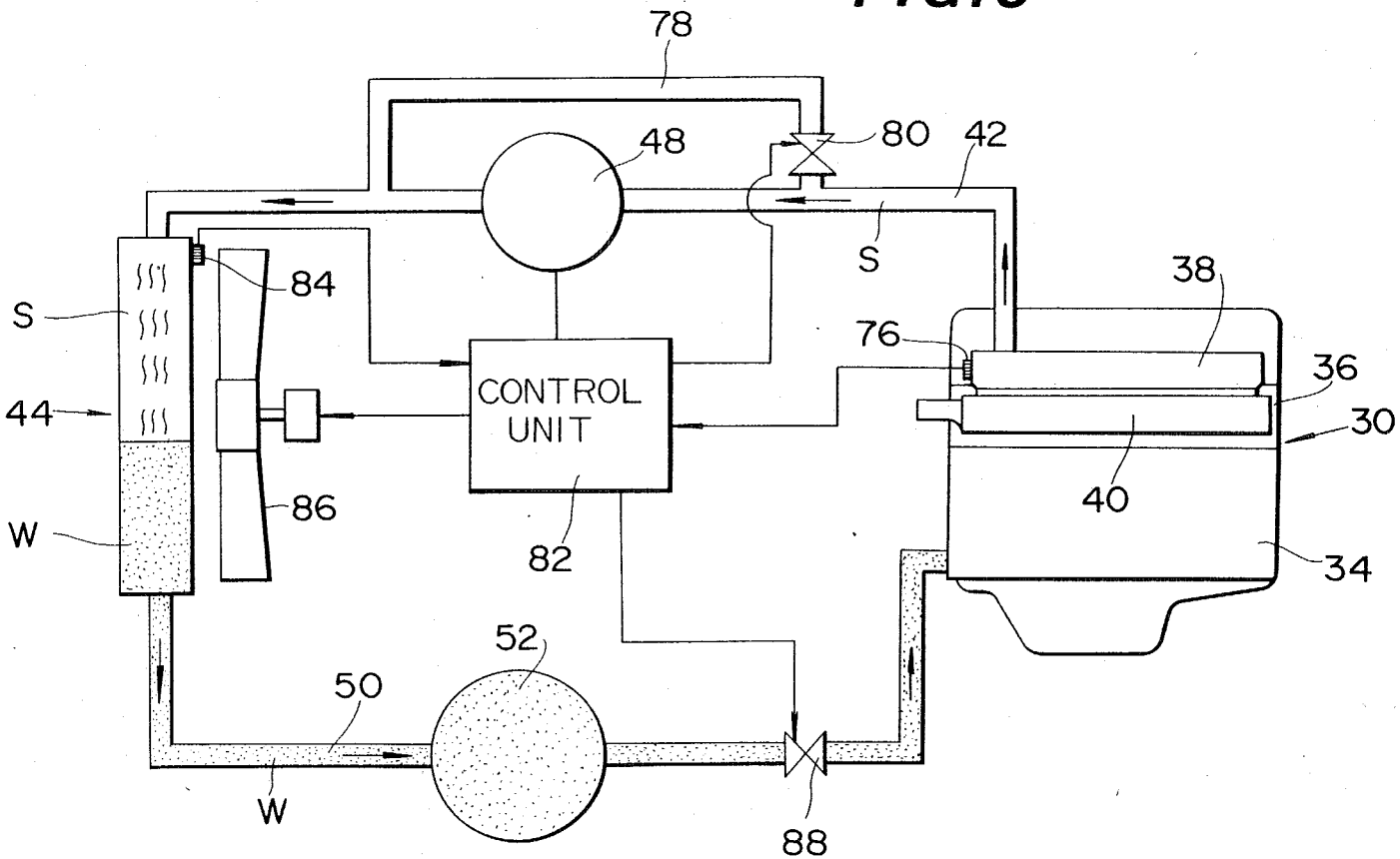
FIG. 5 is a drawing similar to FIG. 2, but showing a cooling system of a second embodiment of the present invention.

Referring to FIG. 5, there is shown a cooling system of a second embodiment of the present invention. The same parts and portions as those in the first embodiment of FIG. 2 are designated by the same numerals.

Like the first embodiment, the engine 30 has a steam chamber 38 which is positioned above the intake manifold 40 and merged with the water jacket of the engine 30. In the water jacket and the steam chamber 38, a suitable amount of water is contained.

Within the steam chamber 38, there is mounted a temperature sensor 76 which detects the temperature of steam in the steam chamber 38. The steam S in the steam chamber 38 is introduced into the compressor 48 through the conduit 42. As shown, a bypass conduit 78 is arranged to bypass the compressor 48. An electromagnetic valve 80 is disposed in the bypass conduit 78 for controlling the steam pressure in the passage 78 in response to electric signals applied thereto. The operation speed of the compressor 48 is controlled by signals issued from a control unit 82 for not only appropriately pressurizing the steam S supplied to the condenser 44 but also appropriately controlling the steam pressure in the steam chamber 38 of the engine 30. In particular, the steam pressure variation in the steam chamber 38 is detected by the temperature sensor 76 as a variation of the saturated steam temperature, and the control unit 82 functions to control the operation speed of the compressor 48 to a value appropriate for effectively cooling the engine 30 in accordance with the information signals issued from the temperature sensor 76. When the temperature sensor 76 senses that the temperature of the steam in the steam chamber 48 is not high enough for achieving normal operation of the engine 30, the control unit 82 stops operation of the compressor 48 and opens the electromagnetic valve 80 so that steam S from the steam chamber 38 is directly introduced into the condenser 44 without being treated by the compressor 48.

The condenser 44 is equipped with another temperature sensor 84 which detects the temperature of the steam S introduced into the condenser 44. A cooling fan 86 is arranged behind the condenser 44. The operation speed of the fan 86 is controlled by the control unit 82 in accordance with the information signals issued from the temperature sensor 84. In particular, the opeation speed of the cooling fan 86 increases with increase of temperature of the steam S supplied to the condenser 44. The high temperature and high pressure steam S supplied to the condenser 44 is cooled there and condensed to a liquid, that is water. The water thus produced is then collected in the reserve tank 52. The water is then reduced in pressure to have a normal pressure by a pressure reducing valve 88 which is controlled by the control unit 82. The water thus reduced in pressure is introduced into the water jacket of the engine 30.

Thus, in the cooling system of the second embodiment, ideal cooling for maintaining the effective engine operation is constantly achieved.

What is claimed is:

1. In a heat engine, a cooling arrangement comprising:

a coolant jacket associated with said engine, said coolant jacket containing a coolant;

a heat exchanger in fluid communication with said coolant jacket;

a compressor interposed between said coolant jacket and said heat exchanger for compressing fluid induced from said coolant jacket and discharging said compressed fluid under pressure into said heat exchanger; and means for transmitting the fluid from said heat exchanger to an inlet of said coolant jacket.

2. A cooling arrangement as claimed in claim 1, further comprising a first valve which is interposed between said heat exchanger and the inlet of said coolant jacket for regulating the pressure of the fluid from said heat exchanger.

3. A cooling arrangement as claimed in claim 2, further comprising a second valve interposed between said compressor and an outlet of said coolant jacket for regulating the pressure of fluid applied to said compressor from said coolant jacket.

4. A cooling arrangement as claimed in claim 3, wherein said second valve is operative to open for connecting said compressor and coolant jacket only when the pressure in said coolant jacket exceeds a predetermined value.

5. A cooling arrangement as claimed in claim 4, wherein said second valve is constructed so that pressure variations caused by operation of said compressor do not affect the substantial operation of said second valve.

6. A cooling arrangement as claimed in claim 2, further comprising a reserve tank which is interposed between said heat exchanger and the first valve for storing the fluid from said heat exchanger.

7. A cooling arrangement as claimed in claim 1, in which said heat exchanger is positioned to receive air ventilation.

8. A cooling arrangement as claimed in claim 1, further comprising a control means for controlling the operation of said compressor in accordance with the temperature of the coolant in said coolant jacket of the engine.

9. A cooling arrangement as claimed in claim 8, further comprising a bypass passage for directly feeding the coolant from said coolant jacket to said heat exchanger when the temperature of said coolant in the coolant jacket is lower than a predetermined amount.

10. A cooling arrangement as claimed in claim 9, further comprising a cooling fan which produces air flow which cools said heat exchanger when the temperature of coolant in said heat exchanger is higher than a fixed amount.

11. A cooling arrangement as claimed in claim 1, further comprising a valve interposed between said compressor and an outlet of said coolant jacket for regulating the pressure of fluid applied to said compressor from said coolant jacket.

12. A cooling arrangement as claimed in claim 11, wherein said valve is operative to open for connecting said compressor and coolant jacket only when the pressure in said coolant jacket exceeds a predetermined value.

13. A cooling arrangement as claimed in claim 12 wherein said valve is constructed so that pressure variations caused by operation of said compressor do not affect the substantial operation of said second valve.

14. A cooling system of an internal combustion engine having a water jacket formed therein, said cooling system comprising:

first means defining a steam chamber in said engine, said steam chamber being merged with said water jacket and being filled with steam when said engine is under operation;

second means for pressurizing the steam issued from said first means to provide a pressurized steam;

third means for cooling and condensing the pressurized steam to provide pressurized water;

fourth means for reducing the pressure of the pressurized water to provide water having a normal pressure;

fifth means for feeding the normally pressurized water into the water jacket of the engine;

means for controlling the operation of said second means in accordance with the temperature of the steam in said steam chamber of the engine; and means for directly feeding the steam issued from said steam chamber to said third means when the temperature of said steam in the steam chamber is lower than a predetermined amount.

15. A cooling arrangement as claimed in claim 14, further comprising means for producing an air flow for cooling said third means in accordance with the temperature of steam supplied to said third means.

* * * * *